US010501935B2

(12) United States Patent
Gunther

(10) Patent No.: US 10,501,935 B2
(45) Date of Patent: Dec. 10, 2019

(54) LAYERED ARCHITECTURAL PERVIOUS CONCRETE

(71) Applicant: INTECRETE, LLC, Santa Ana, CA (US)

(72) Inventor: Mike Gunther, Orange, CA (US)

(73) Assignee: INTECRETE, LLC, Santa Ana, CA (US)

( * ) Notice: Subject to any disclaimer, the term of this patent is extended or adjusted under 35 U.S.C. 154(b) by 867 days.

(21) Appl. No.: 14/960,797

(22) Filed: Dec. 7, 2015

(65) Prior Publication Data

US 2016/0090737 A1 Mar. 31, 2016

Related U.S. Application Data

(62) Division of application No. 14/109,376, filed on Dec. 17, 2013, now abandoned.

(60) Provisional application No. 61/739,201, filed on Dec. 19, 2012.

(51) Int. Cl.

| | |
|---|---|
| ***E04B 5/32*** | (2006.01) |
| ***E01C 7/14*** | (2006.01) |
| ***E01C 11/22*** | (2006.01) |

(52) U.S. Cl.

CPC ..... *E04B 5/32* (2013.01); *E01C 7/14* (2013.01); *E01C 11/226* (2013.01); *Y10T 428/183* (2015.01); *Y10T 428/187* (2015.01)

(58) Field of Classification Search

CPC ..... E01C 7/142; E01C 7/145; E01C 7/147; E01C 7/16; E01C 5/003; E04B 5/32; Y02A 30/32; B29C 67/242

See application file for complete search history.

(56) References Cited

U.S. PATENT DOCUMENTS

| | | | | |
|---|---|---|---|---|
| 3,969,851 | A | 7/1976 | Whitacre | |
| 5,593,753 | A * | 1/1997 | Rice | B32B 7/02 428/131 |
| 5,788,407 | A | 8/1998 | Hwang | |
| 7,168,884 | B2 | 1/2007 | Hart | |
| 8,312,690 | B1 | 11/2012 | Klemaske, II et al. | |

FOREIGN PATENT DOCUMENTS

| | | | |
|---|---|---|---|
| CN | 20220887 | U | 5/2012 |
| CN | 102454143 | A | 5/2012 |
| EP | 722014 | * | 8/1995 |
| JP | 11100804 | * | 9/1997 |
| JP | 11100804 | A | 4/1999 |
| JP | 2012046971 | A | 3/2012 |

* cited by examiner

*Primary Examiner* — Stella K Yi

(74) *Attorney, Agent, or Firm* — David Duckworth

(57) ABSTRACT

A layered architectural water pervious concrete is provided. The concrete assembly includes a first layer of water pervious concrete preferably having 15%-25% void space capable of channeling water to the ground and underlying water table. Poured upon the pervious concrete layer, is a non-pervious concrete layer. Joints are formed through the non-pervious concrete layer, which preferably penetrates into the pervious concrete layer at least ¼ inch. Water flows from the top surface of the concrete assembly through the joints and into the porous concrete layer for distribution to the ground below.

9 Claims, 2 Drawing Sheets

LAYERED ARCHITECTURAL PERVIOUS CONCRETE

RELATED APPLICATIONS

Figure 1:
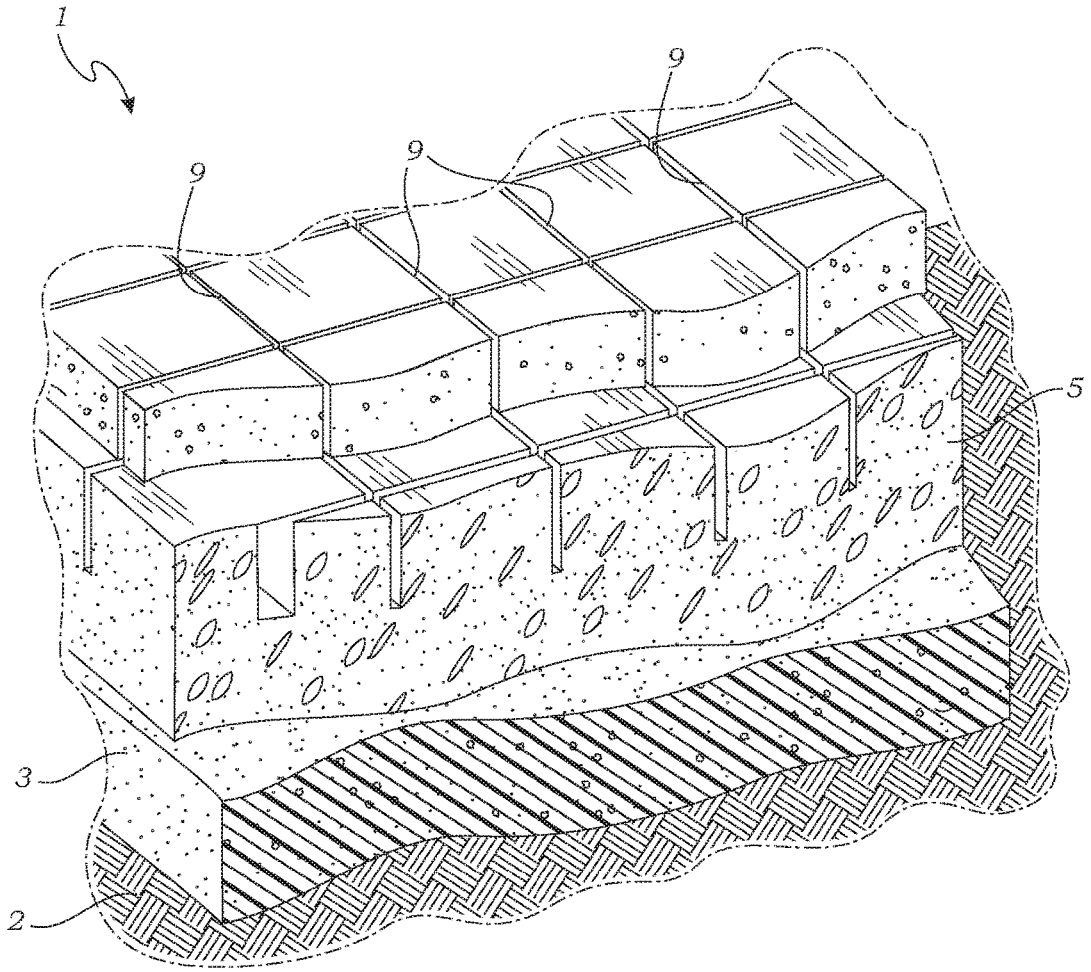

The present application is a divisional application of co-pending U.S. patent application Ser. No. 14/109,376 filed Dec. 17, 2013, which in turn is a continuation-in-part of U.S. Provisional Patent Application Ser. No. 61/739,201 filed on Dec. 19, 2012.

BACKGROUND OF THE INVENTION

The present invention relates generally to concrete, and more particularly to water permeable concrete systems.

Concrete is extensively utilized as a building material for industrial, commercial and residential applications. Due to its durability, wear resistance and cost economy, concrete has gained widespread use in walked upon and driven upon applications. Part of the problem when constructing aesthetically pleasing surfaces is that current design and engineering methods require the use of integrated surface drain systems to capture and channel away excess water, rain and run-off into drainage systems. However, they are visually detracting from the overall finish surfaces being placed and take-away from the natural look of some of the concrete or simulated natural materials one may be re-creating in concrete.

Pervious concrete, also commonly referred to as porous concrete, permeable concrete, and no-fines concrete, has been commonly used to effectively capture and divert storm water runoff. Pervious concrete is a special type of concrete having a high porosity that allows water and other liquids to pass directly through the concrete thereby reducing the runoff from a site. Typically, the water is diverted directly into the ground for introduction into the water table. Pervious concrete functions like a storm water infiltration basin and allows water to saturate soil over a large area, thus facilitating the introduction of water into the groundwater supplies locally. As a result, pervious concrete is recognized as a "Best Management Practice" by the United States Environmental Protection Agency.

Pervious concrete consists of cement, coarse aggregate and water, with little to no fine aggregates. The addition of a small amount of sand will increase strength, but decrease porosity. This may be desirable in cold climates where higher strength due to freezing is a concern. Typically, the water to cement ratio is 0.28-0.40 with a void content of 15%-25%. This results in the pervious concrete having a water flow rate of 2-18 gallons per minute per square foot.

Unfortunately, pervious concrete suffers from several disadvantages. Most notable is that the lower density results in significantly lower strength. Accordingly, pervious concrete is typically used in lower trafficked roadways, parkways, or walkways. Where higher traffic and durability is a concern, pervious concrete is typically not acceptable. Furthermore, depending on the region, the cost of pervious concrete may be 15%-25% higher than conventional impervious concrete. Due to these disadvantages, pervious concrete has faced difficulties in its adoption in the United States.

Various attempts have been made to create concrete structures which provide water porosity and improved characteristics. For example, U.S. Pat. No. 7,168,884 describes a paving structure which is water permeable. The structure includes an upper layer of blocks, and lower layers of coarse granular material, a geotextile membrane, a sub-base of gravel or concrete, and a subgrade below. Water is permitted to flow through this concrete structure. However, the structure is expensive and more difficult to build than traditional concrete structures. U.S. Pat. No. 5,788,407 also describes a paving structure which is water permeable. This structure includes two layers of water permeable concrete. Unfortunately, these layers of water permeable concrete lack the strength of conventional concrete. Meanwhile, U.S. Pat. No. 8,312,690 describes a pervious concrete structure. Again, the concrete structure includes an upper pervious concrete layer which may contain decorative aggregates. Below the decorative pervious concrete layer is an additional pervious concrete layer connected by an acrylic binder. Unfortunately, the impervious concrete layers lack the strength of conventional concrete.

Thus, there is a need for an improved concrete construction that allows for the drainage of water without the cost of integrated surface drainage systems. Furthermore, there is a need to provide a level flat top surface that is aesthetically pleasing which does not permit standing surface water. This would be a significant benefit for the advancement of the Americans with Disabilities Act (ADA) which requires certain characteristics of walking surfaces.

Moreover, there is a significant need for a pervious concrete system which has improved strength and durability compared to previous pervious concrete constructions.

Thus, there is a significant need for an improved a concrete paving system that creates a safer surface and is not detrimentally impacted by the design or engineering constraints utilizing traditional methods of paving surface drainage systems.

SUMMARY OF THE INVENTION

The present invention addresses the aforementioned disadvantages by providing an improved layered concrete construction which is pervious to water while still maintaining the aesthetically pleasing appearance of traditional impervious concrete. It is envisioned that the present invention will most often require the preparation of the subgrade for creating substantially horizontal surfaces such as for walkways, driveways and the like. Though not preferred, the present invention may be utilized for producing vertical or substantially inclined concrete surfaces such as walls, seatwalls, water features, etc. When creating a substantially inclined concrete construction, a traditional formwork utilizing wood, steel or other materials is assembled to create an envelope for receipt of a concrete mixture. Where preparing a traditional subgrade, the subgrade is prepared to the desired elevation and grade. Preferably, the subgrade is compacted to a desired compaction, such as 90%.

Optionally, the subgrade may be excavated to form trenches for directing water to desired locations. Alternatively, filter fabrics or sub-drain systems may be installed, particularly where native soils are particularly impenetrable, in other words non-pervious to water, such as in high clay environments.

After the subgrade has been prepared, including the optional trenches, filter fabrics or sub-drain system, it is preferred that subgrade be covered by a layer of base-coarse material. The base-coarse material may be selected by those skilled in the art, such as a soils engineer. Typical base-coarse materials may include traditional fill sand, gravel, and aggregate base-coarse.

Once the subgrade, base-coarse material and any reinforcement members have been prepared, the present invention requires the preparation and pour of a pervious concrete mixture. Pervious concrete is a special type of concrete with a high porosity which allows water from rain and other run-off to pass directly through the concrete. Pervious concrete typically utilizes large aggregates and little or no fine aggregates. For the practice of the present invention, it is preferred that the pervious concrete have a 5%-50% void space. More preferably, the pervious concrete has a 10%-35% void space capable of providing a water flow rate of 2-18 gallons per square foot per minute. The preparation of the pervious concrete can be determined by those skilled in the art, and may require minor modifications as a result of the chemistry of the concrete being employed. Once the pervious concrete has been prepared, it is poured over the subgrade and base-coarse material to create a layer of pervious concrete which is porous to rain and other water run-off.

After the pervious concrete has been poured, a second layer of traditional concrete is poured upon the still plastic pervious concrete layer. Preferably, the pervious concrete has cured, and no longer in a plastic state, prior to pouring the traditional concrete layer. Pervious concrete will cure at different rates depending on ingredients and conditions including temperature and humidity. Thus, the pervious concrete may remain plastic after poured for up to twenty-eight (28) days. Preferably, the traditional, non-pervious concrete, consists of at least 5.5 standard sacks of cement, preferably Portland cement, per cubic yard. This "topping" layer of standard concrete is poured to a thickness as can be determined by those skilled in the art. Preferably, the topping layer of standard concrete is ⅜ inch to 6 inches thick depending on how the surface is used, such as a walkway or high traffic area for automobiles.

It is preferred, though not necessary, that reinforcement members be introduced into the concrete topping layer. The reinforcement members may include wire mesh, rebar, integral fiber mesh or the like so as to increase the resulting strength of the concrete slab.

After the standard concrete mixture has been poured over the plastic pervious concrete mixture, the concrete's surface is "floated" or "screed" to a desired level plane or grade. Preferably, the surface of the concrete is floated utilizing steel, aluminum, wood, fiberglass or magnesium concrete bull-float tools. Where the concrete slab has a large square footage, the use of hand floats may be abandoned and more efficient screeds including laser screeds, roller screeds, texas screeds, or manually pushed or motorized finishing machines may be utilized. Preferably, though not necessary, the concrete upper surface is also troweled to create a substantially homogenous concrete surface having a substantially uniform finish.

Of importance, to prepare the layered architectural water pervious concrete structure of the present invention, joints are formed into the top standard concrete layer. The formation of the joints are determined by those skilled in the art. For example, the joints may be installed utilizing tools during finishing, such as sawed with a blade or the like. However, the saw joints may not be practical if the concrete is made with hard aggregates, such as quartz gravel. Alternatively, tooled joints may be placed when the topping slab is still in a plastic state. Of importance, the joints must be formed to a depth of at least equal to or greater than the thickness of the upper topping slab. In other words, the joints must project entirely from the top of the topping layer of standard concrete all the way through to the lower pervious layer of concrete. In an alternative embodiment, the joints project all the way through the top layer of standard concrete and project partially into the pervious layer of concrete to provide for greater acceptance of water run-off through the layers of concrete and into the ground. Preferably the joints extend downwardly ¼ inch to 2 inches into the pervious concrete layer.

The upper topping layer may be modified for increasing the aesthetics of its appearance. To this end, color "finishes" including color additives and color hardeners may be applied. Alternatively, the topping layer may be constructed to include an aggregate finish. If the topping layer is to include an aggregate finish, the aggregate may be premixed with the standard concrete prior to the topping layer being poured to produce an integrally mixed aggregate concrete. Alternatively, a surface seeded exposed aggregate may be introduced. For this method, after the topping layer has been poured, but while it is still in a plastic state, an aggregate is broadcast (also referred to as "seeded") over the top surface of the concrete. The aggregate is troweled into the concrete so as to form a planar concrete surface. Traditional aggregates may be employed such as stone, gravel, shells, or glass, which can be readily seen after the upper surface has been exposed. The aggregate upper surface can be exposed utilizing traditional chemical retardants or mechanical exposure utilizing brushes, sponges or rotary flooring machines having abrasive pads. Media blasting may also be employed to expose the aggregate upper surface. Preferably, the upper surface is allowed to dry overnight and an optional sealant is applied. Various concrete sealants can be selected and utilized as can be determined by those skilled in the art.

The layered concrete structure of the present invention provides safer, more environmentally sensitive, and superior aesthetics to current concrete systems utilizing surface area drains.

DETAILED DESCRIPTION OF THE DRAWINGS

Figure 2:
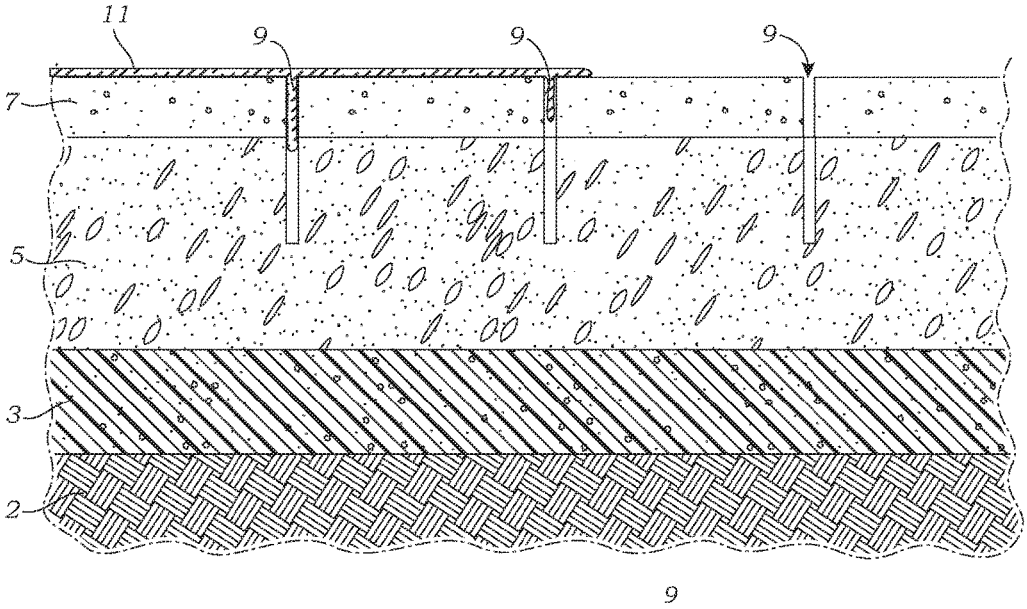
Figure 3:
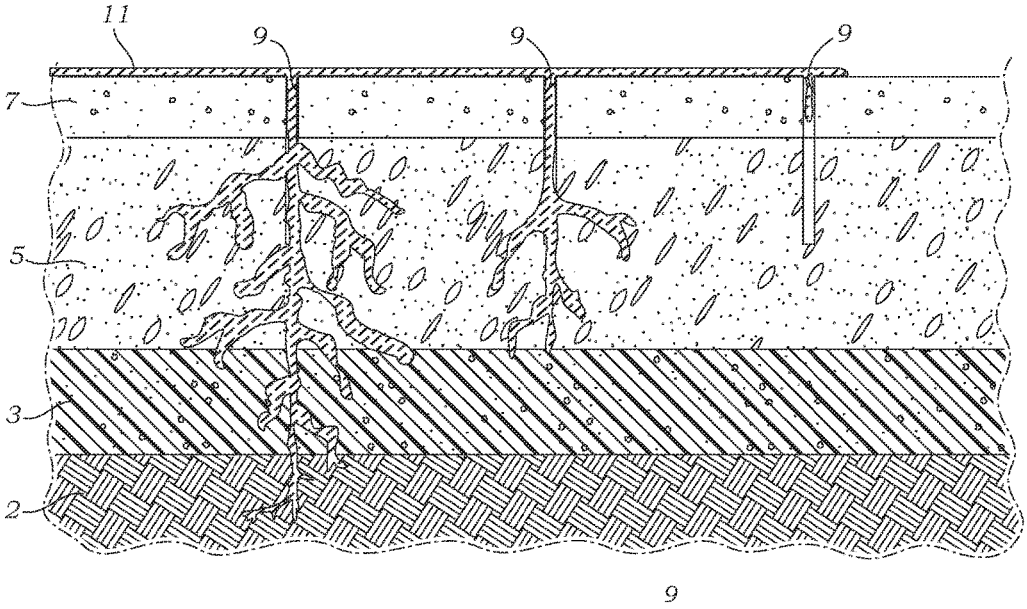

FIG. 1 is a perspective cross-sectional view of the various layers of a first embodiment of a layered architectural water pervious concrete of the present invention;

FIG. 2 is a side cross-sectional view illustrating the various layers of an embodiment of a layered architectural water pervious concrete of the present invention wherein water has started to seep into the joints; and FIG. 3 is a side cross-sectional view illustrating the various layers of an embodiment of a layered architectural water pervious concrete of the present invention wherein water has seeped through the joints and into the pervious concrete, base-coarse layer, and into the subgrade below.

DETAILED DESCRIPTION OF THE INVENTION

While the present invention is susceptible of embodiment of various forms, as shown in the drawings, hereinafter will be described the presently preferred embodiments of the invention with the understanding that the present disclosure is to be considered as an exemplification of the invention and it is not intended to limit the invention to the specific embodiments illustrated.

With reference to FIGS. 1-3, the concrete assembly 1 of the present invention includes a top layer of traditional non-pervious concrete 7. This layer of non-pervious concrete 7 has a preferred thickness of ⅜ inch-6 inches, and a more preferred thickness of ⅜ inch-4 inches. Advantageously, this non-pervious concrete 7 will provide 2500-4000 pounds per square inch p.s.i. compressive strength.

Underneath the non-pervious concrete layer 7, the concrete assembly 1 includes a pervious concrete layer 5.

Preferably, the pervious concrete layer 5 is 2-6 inches thick and has 5%-50% void space. Even more preferably, the pervious concrete 5 has 10%-35% void space capable of providing a water flow rate of 2-18 gallons per square foot per minute.

Still with reference to FIGS. 1-3, the concrete assembly 1 includes joints 9. The joints 9 penetrate entirely through the non-pervious concrete layer 7, and preferably extend at least partially into the pervious layer of concrete 5. Preferably, the joints 9 penetrate at least ¼ inch in depth into the pervious concrete layer 5. Even more preferably, the joints 9 penetrate ¼ inch-2 inches into the pervious concrete layer 5. Preferably the joints 9 are ⅛ inch-3⁄16 inch in width. The preferred joint is 3⁄16 inch in width. The concrete assembly 1 may include a single joint. However, it is preferred that the concrete assembly include a plurality of joints spaced in accordance with traditional concrete construction such as with spacing of 2 feet-10 feet. Furthermore, the joints 9 may be laid out in various configurations including, but not limited to, parallel, perpendicular grid, or diamond shaped configurations.

Advantageously, the top non-pervious concrete layer 7 provides a pleasing decorative finish having increased strength and durability. With reference to FIGS. 2 and 3, the joints 9 act as channels to capture and divert water 11 from the surface of non-pervious concrete layer 7 to the pervious concrete layer 5. Meanwhile, the pervious concrete layer 5 provides a sufficiently strong support layer and sound dampening barrier while also channeling and distributing water 11 to the ground and underlying water table. Advantageously, the construction of the concrete assembly 1 of the present invention can be accomplished primarily utilizing known construction methods to accomplish a previously unknown structure providing previously unknown benefits. To prepare this concrete assembly 1, a subgrade 2 or formwork (not shown) is prepared. A formwork will utilize wood or metals to create a mold for receipt of a concrete mixture. Conversely, a traditional subgrade 2 is prepared by simply modifying the underlying elevation and grade of the ground. Preferably, the subgrade 2 is compacted, such as to 90%. Water 11 from the upper non-pervious concrete layer 7 and pervious concrete layer 5 may be distributed evenly through the subgrade 2 to the ground. Alternatively, the subgrade 2 may be excavated and/or compacted to divert water such as for collection. Though not necessary, the subgrade 2 may be covered by a layer of base-coarse material 3. Typical base-coarse materials may include sand, gravel and aggregates.

The layer of pervious concrete 5 is poured upon the subgrade 2 and optional base-coarse materials 3. As explained above, the pervious concrete 5 has 5%-50% void space, and preferably 10%-35% void space, and still even more preferably, between 15%-25% voids. The void spaces are determined by carefully controlling the amounts of water and cementitious materials which are used to coat the aggregate particles. Preferably, little or no sand is utilized in the pervious concrete layer 5, but sufficient cementitious paste is utilized to coat and bind the aggregate particles to create a system of highly permeable, interconnected voids that allows the drainage of water 11. Though pervious concrete is capable of providing a water flow rate of 2-18 gallons per square foot per minute, a typical flow rate through pervious concrete 5 is 5 gallons per square foot per minute.

Preferably, before the pervious concrete layer 5 has cured, the non-pervious concrete layer 7 is poured upon the pervious concrete layer 5. Though still in a plastic state, which may continue for up to 28 days after being poured, it is preferred that the pervious concrete layer 5 be allowed to cure sufficiently so as to properly set so as to not be compacted by the weight of the non-pervious concrete layer 7.

Joints 9 are formed entirely through the non-pervious concrete layer 7 and partially into the pervious concrete layer 5. Typically the joints 9 may be installed utilizing tools such as saws or blades or the like when finishing the concrete's surface. However, where the concrete employs hard aggregates, such as coarse gravel, the joints 9 may be molded by utilizing mechanical spacers.

The upper exposed surface of the non-porous concrete layer 7 may be modified to improve the surfaces aesthetics, texture or durability. To this end, color additives and/or color hardeners may be applied. Alternatively, traditional sealants may be utilized to seal the upper exposed surface. Furthermore, decorative aggregates may be utilized to provide improved aesthetics. Implementing each of these finishes can be determined by those skilled in the art.

Once completed, the concrete assembly of the present invention provides an aesthetically superior construction with virtually invisible water channeling capabilities.

While several particular forms of the invention have been illustrated and described, it will be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice it, and having presently identified the presently preferred embodiments thereof,

I claim:

1. A method of producing a layered architectural pervious concrete, the method comprising the steps of:

(a) preparing a subgrade for receipt of a poured concrete mixture;

(b) pouring a pervious concrete mixture upon the subgrade to form a layer of pervious concrete and create a pervious concrete surface;

(c) after the pervious concrete mixture has been poured upon the prepared subgrade, pouring an impervious concrete mixture upon the pervious concrete surface to form a layer of impervious concrete and create an exposed impervious concrete surface, and wherein the pouring of the impervious concrete mixture upon the pervious concrete surface is conducted while the pervious layer of concrete is still in a plastic state; and (d) forming one or more joints into the layer of impervious concrete with the one or more joints extending at least from the exposed impervious concrete surface to the pervious concrete surface.

2. The method of producing a layered architectural pervious concrete of claim 1 wherein the one or more joints extend at least ¼ inch into the layer of pervious concrete.

3. The method of producing a layered architectural pervious concrete of claim 1 wherein the one or more joints extend through the layer of pervious concrete and partially into the layer of pervious concrete but not all the way through the layer of pervious concrete.

4. The method of producing a layered architectural pervious concrete of claim 1 wherein the step of forming one or more joints includes sawing through the layer of impervious concrete.

5. The method of producing a layered architectural pervious concrete of claim 1 wherein the step of forming joints includes pre-molding joints through the layer of impervious concrete.

6. The method of producing a layered architectural pervious concrete of claim 1 wherein the pervious concrete has at least 5% voids.

7. The method of producing a layered architectural pervious concrete of claim 1 wherein the pervious concrete has at 10-30% voids.

8. The method of producing a layered architectural pervious concrete of claim 1 wherein the pervious concrete provides a water flow rate of at least 2 gallons per minute per square foot.

9. The method of producing a layered architectural pervious concrete of claim 1 further comprising the steps of:

(a) broadcasting a decorative aggregate upon the exposed impervious concrete surface;

(b) troweling the decorative aggregate into the exposed impervious concrete surface; and (c) exposing the decorative aggregate within the exposed impervious concrete surface.

* * * * *